US007914214B2

(12) United States Patent
Craig

(10) Patent No.: US 7,914,214 B2
(45) Date of Patent: Mar. 29, 2011

(54) SYSTEM AND METHOD FOR DETERMINING THE STATUS OF A LABEL IN A ROLL OF LABEL STOCK

(75) Inventor: James Thomas Craig, Newtown, CT (US)

(73) Assignee: Sanford, L.P., Oak Brook, IL (US)

( * ) Notice: Subject to any disclaimer, the term of this patent is extended or adjusted under 35 U.S.C. 154(b) by 0 days.

(21) Appl. No.: 12/490,299

(22) Filed: Jun. 23, 2009

(65) Prior Publication Data

US 2009/0261170 A1 Oct. 22, 2009

Related U.S. Application Data

(63) Continuation of application No. 11/305,022, filed on Dec. 19, 2005, now abandoned, which is a continuation of application No. PCT/IB2004/002194, filed on Jun. 21, 2004.

(60) Provisional application No. 60/480,558, filed on Jun. 20, 2003.

(51) Int. Cl.
*B41J 15/00* (2006.01)

(52) U.S. Cl. ..... 400/613; 101/288; 156/360; 156/387

(58) Field of Classification Search ..... 400/611–613, 400/615, 621.1; 101/288; 156/360, 387, 156/577
See application file for complete search history.

(56) References Cited

U.S. PATENT DOCUMENTS 4,755,834 A 7/1988 Kunimitsu et al.
5,708,462 A 1/1998 Helmbold et al.
5,782,496 A 7/1998 Casper et al.
6,172,688 B1 1/2001 Iwasaki et al.
2004/0050854 A1 3/2004 Presutti et al.
2005/0214054 A1 9/2005 Hoshino et al.
2006/0134365 A1 6/2006 Blank et al.
(Continued)

FOREIGN PATENT DOCUMENTS

EP 0 710 567 5/1996
(Continued)

OTHER PUBLICATIONS

Translation of Notification of Reasons for Refusal (Office Action) from Japanese Patent Application No. 2006-516593.
(Continued)

*Primary Examiner* — Ren Yan
(74) *Attorney, Agent, or Firm* — Marshall, Gerstein & Borun LLP

(57) ABSTRACT

A method and system for determining whether a first one of a plurality of labels on a roll of label stock is a full label. The method includes sensing a leading edge of the roll of label stock, sensing a location of a first one of a plurality of indicator marks that are printed on the back side of the roll of label stock, sensing a location of a second one of the plurality of indicator marks, sensing a location of one of a plurality of top of form marks that are printed on the back side of the roll of label stock. The method further includes determining whether the first one of the plurality of labels is a full label based on the leading edge of the roll of label stock, the location of the first one of the plurality of indicator marks, the location of the second one of the plurality of indicator marks, and the location of the one of the plurality of top of form marks.

22 Claims, 8 Drawing Sheets

U.S. PATENT DOCUMENTS

| | | | |
|---|---|---|---|
| 2006/0182920 | A1 | 8/2006 | Craig |
| 2008/0193190 | A1 | 8/2008 | Craig |

FOREIGN PATENT DOCUMENTS

| | | | |
|---|---|---|---|
| EP | 1 151 871 | | 11/2001 |
| JP | 6-052350 | A | 2/1994 |
| JP | 9-240121 | A | 9/1997 |
| JP | 2000-141775 | A | 5/2000 |
| JP | 2000127507 | A | 5/2000 |
| JP | 2000-168180 | | 6/2000 |
| JP | 2001019247 | A | 1/2001 |
| JP | 2002-178578 | | 6/2002 |
| JP | 2003-076277 | A | 3/2003 |
| WO | WO-98/16391 | | 4/1998 |

OTHER PUBLICATIONS

International Search Report for PCT/IB2004/002194, dated Jun. 12, 2004.

Written Opinion for PCT/IB2004/002194, dated Jun. 12, 2004.

10

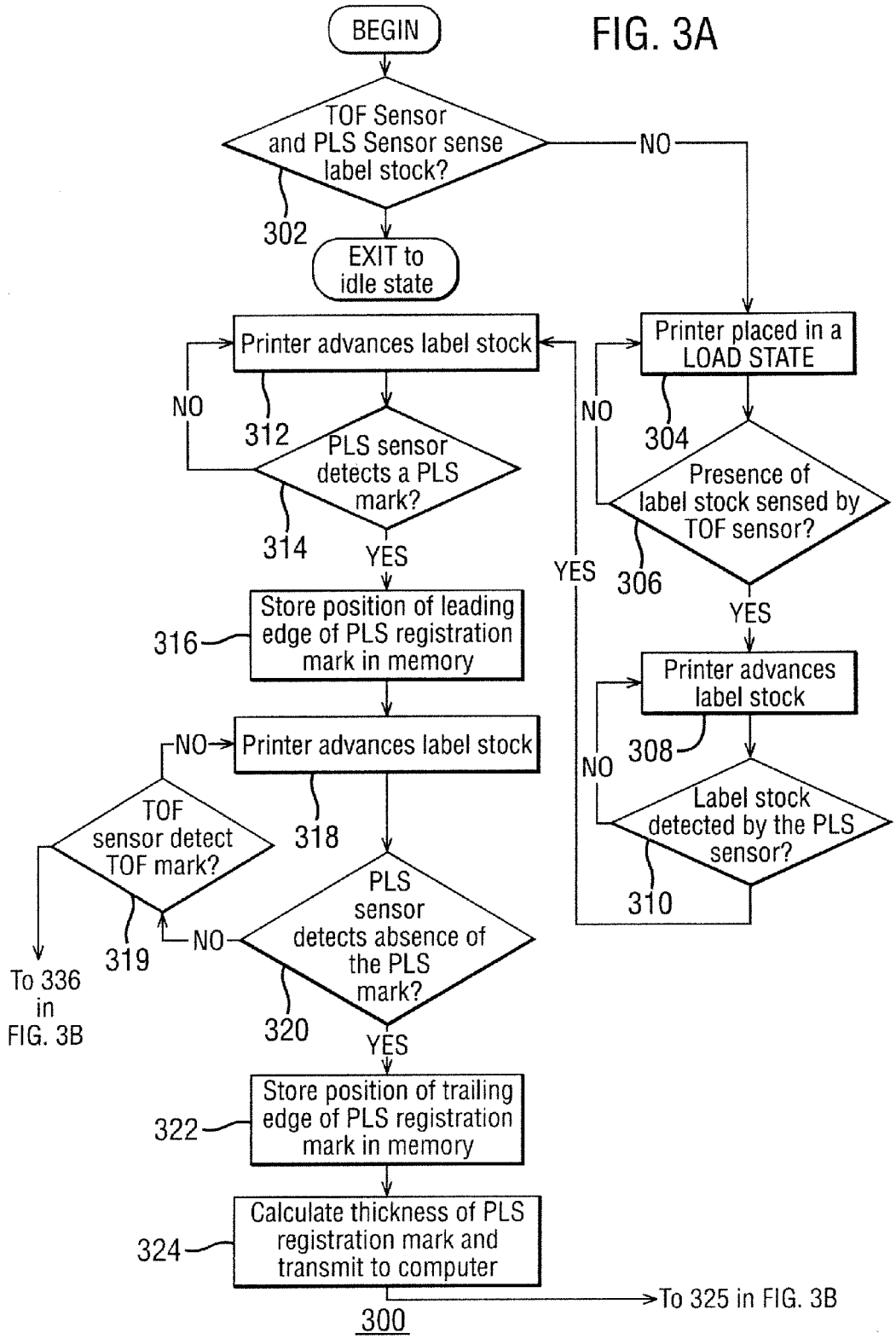
FIG. 3A
BEGIN
TOF Sensor and PLS Sensor sense label stock?
NO
302
EXIT to idle state
Printer advances label stock
Printer placed in a LOAD STATE
NO
312
PLS sensor detects a PLS mark?
NO
304
Presence of label stock sensed by TOF sensor?
314
YES
YES
306
YES
Store position of leading edge of PLS registration mark in memory
316
Printer advances label stock
NO
Printer advances label stock
308
NO
TOF sensor detect TOF mark?
318
Label stock detected by the PLS sensor?
310
PLS sensor detects absence of the PLS mark?
319
NO
To 336 in FIG. 3B
320
YES
Store position of trailing edge of PLS registration mark in memory
322
Calculate thickness of PLS registration mark and transmit to computer
324
To 325 in FIG. 3B
300

SYSTEM AND METHOD FOR DETERMINING THE STATUS OF A LABEL IN A ROLL OF LABEL STOCK

REFERENCE TO RELATED APPLICATIONS

This application is a continuation of U.S. patent application Ser. No. 11/305,022, filed Dec. 19, 2005 as a continuation of International Patent Application No. PCT/IB04/002194, having an international filing date of Jun. 21, 2004, which in turn claims the benefit of the filing date of Provisional Application No. 60/480,558, filed Jun. 20, 2003.

BACKGROUND OF THE INVENTION

1. Technical Field

The present invention relates to the printing of information onto a material, and more particularly, to determining the status of a label, positioning the label, and printing information onto the label, when the label is attached to a roll of label stock.

2. Background Art

The number of labels and the presence of undesirable partial labels at the beginning of a roll of label stock are artifacts of the label manufacturing process. During the manufacture of label stock, the length of the label stock that has passed through a manufacturing machine is the determining parameter for the ending point of one roll of label stock and the beginning point of the subsequent roll of label stock. The positional accuracy of the manufacturing equipment is such that the demarcation point between label rolls is random and has no positional relationship to the die cut label on the continuous label carrier. Therefore, it is highly probable that the first label of a previously unused roll of label stock will begin with a partial label.

On the other hand, during normal use of a label printer such as a DYMO LabelWriter printer, the user typically separates individual full printed labels at the exit point of the printer after the completion of a print job. Therefore, the first label of a previously used roll of label stock will typically always begin with a full label.

The method that is currently used by label printers to eliminate the potential for printing onto a partial label the first time a printer prints onto a newly loaded roll of label stock is to advance the label stock forward until a top of from (TOF) mark is detected by the TOF sensor during the label stock roll loading process. While this insures that the label printer will always print to a full label, the process always wastes a full or partial label. Because a previously loaded label stock roll always begins with a full label, this is a deterrent for users to change label rolls and potentially effects overall label usage.

Earlier efforts to solve this problem have failed because they required the first label to be advanced completely past the platen/print head interface point and through the angle produced by this transition. This frequently causes the label printer to malfunction as the die cut label is likely to peel away from the label stock carrier as it is reverse fed through the platen/print head transition angle.

Seiko Instruments USA, Inc. (hereinafter "Seiko") manufactures label printers and label stock. Some of the label stock produced by Seiko is believed to include a series of marks printed on the back side of the label stock. Each of these marks is believed to correspond with a label adhered to the front side of the label stock. Each of the marks is believed to be offset from the leading edge of the corresponding label by a standard distance. No matter what type of label is adhered to the front side of the label stock, each of the marks is believed to be offset from the leading edge of the corresponding label by the standard distance. Therefore, Seiko label printers are not believed to be capable of determining whether the first label in a roll of label stock is a full label or a partial label, nor are Seiko label printers believed to be able to determine any other parameter associated with the label stock.

Accordingly, there exists a need for determining whether the first label in the roll of label stock is a whole label and positioning the first label appropriately in the printer.

SUMMARY OF THE INVENTION

An object of the present invention is to provide system and method for determining whether the first label in a roll of label stock is a partial label or a full label.

A further object of the present invention is to provide a computer system with information pertaining to the width and length of a label adhered to a roll of label stock.

In order to meet these objectives and others that will become apparent with reference to the disclosure below, in one exemplary embodiment of the present invention, a roll of labels is provided. The roll of labels includes a substrate having a front side and a back side, wherein at least one indicator mark is printed on the back side of the substrate, wherein one of the at least one indicator mark has a particular width. The roll of labels also includes at least one label, wherein one of the at least one label is adhered to the front side of the substrate, wherein the one of the at least one label has a particular width, wherein the particular width of the one of the at least one indicator mark is indicative of the particular width of the one of the at least one label.

In another exemplary embodiment of the present invention, a roll of labels is provided. The roll of labels includes a substrate having a front side and a back side, wherein a plurality of indicator marks are printed on the back side of the substrate. The roll of labels also includes a plurality of labels, each of the plurality of labels being associated with at least one of the plurality of indicator marks, one of the plurality of labels having a particular length, wherein the distance between an adjacent pair of the plurality of indicator marks associated with the one of the plurality of labels is indicative of the length of the one of the plurality of labels.

Preferably each of said plurality of labels has particular width.

Preferably said one of said at least one indicator mark is associated with said one of said plurality of labels.

Preferably said one of said at least one indicator mark is associated with said one of said plurality of labels based on position.

Preferably said one of said at least one indicator mark is printed on said back side of said substrate and said one of said plurality of labels is adhered to said front side of said substrate at adjacent locations.

Preferably said one of said at least one indicator mark is printed on said back side of said substrate and said one of said plurality of labels is adhered to said front side of said substrate at offset locations.

In still another exemplary embodiment of the present invention, a method is provided for determining whether a first one of a plurality of labels on a roll of label stock is a full label. The method includes sensing a leading edge of the roll of label stock, sensing a location of a first one of a plurality of indicator marks that are printed on the back side of the roll of label stock, sensing a location of a second one of the plurality of indicator marks, and sensing a location of one of a plurality of top of form marks that are printed on the back side of the roll of label stock. The method further includes determining whether the first one of the plurality of labels is a full label based on the leading edge of the roll of label stock, the location of the first one of the plurality of indicator marks, the location of the second one of the plurality of indicator marks, and the location of the one of the plurality of top of form marks.

In still another exemplary embodiment of the present invention, a label printing apparatus is provided for printing on a roll of label stock, said label printing apparatus comprising: a first sensor for sensing a leading edge of said roll of label stock, and for sensing a location of one of a plurality of top of form marks that are printed on said back side of said roll of label stock; a second sensor for sensing a location of a first one of a plurality of indicator marks that are printed on a back side of said roll of label stock, and for sensing a location of a second one of said plurality of indicator marks; determining means responsive to said first and second sensor for determining whether said first one of said plurality of labels is a full label based on: said leading edge of said roll of label stock; said location of said first one of said plurality of indicator marks; said location of said second one of said plurality of indicator marks; and said location of said one of said plurality of top of form marks.

The accompanying drawings, which are incorporated into and constitute part of this disclosure, illustrate preferred embodiments of the invention and serve to explain the principles of the invention.

BRIEF DESCRIPTION OF THE DRAWINGS

FIGS. 3A-3C are flow charts of a process for loading a roll of label stock, determining whether the first label of the roll of label stock is a partial label, and positioning the roll of label stock 102 in accordance with the present invention;

Figure 1:
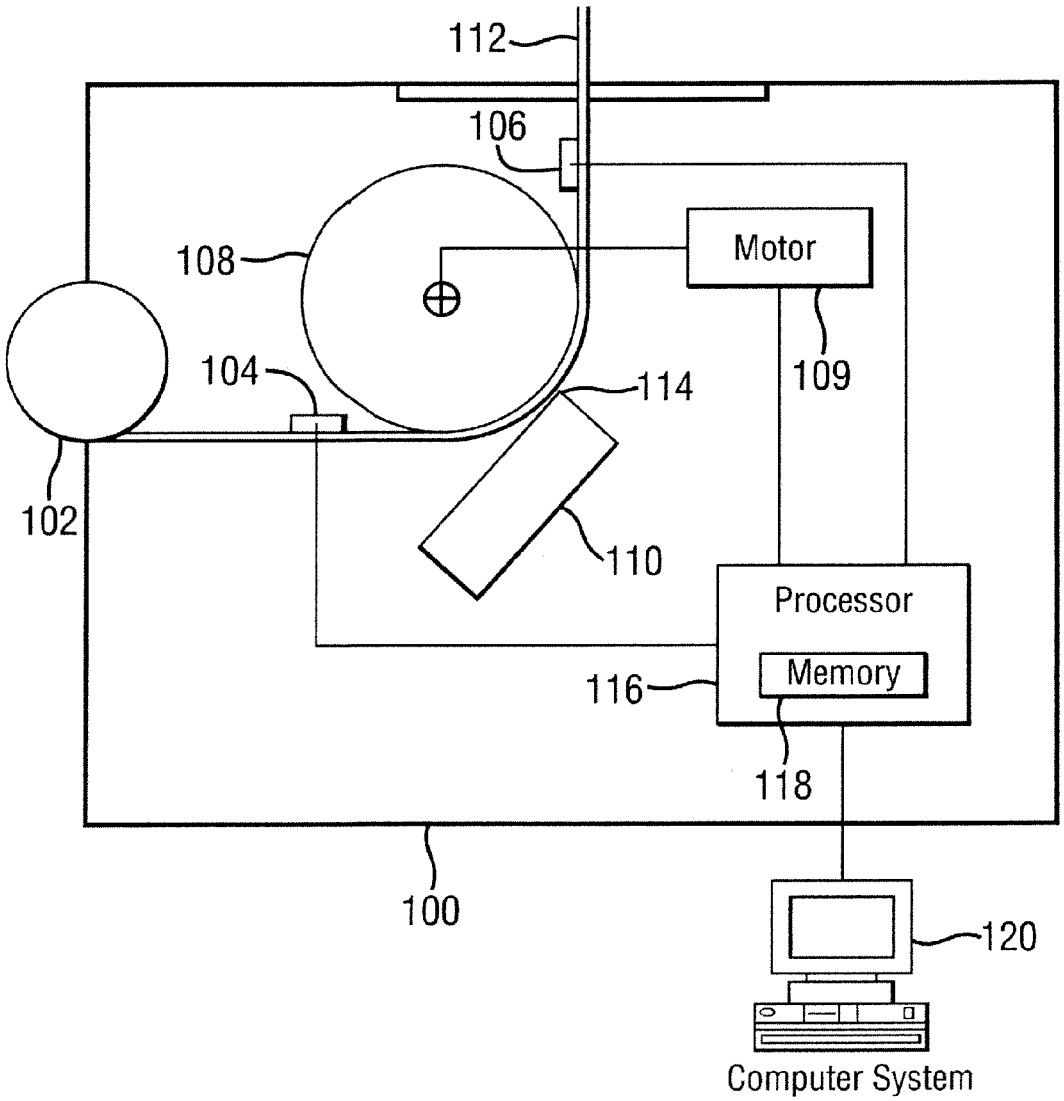
FIG. 1 is a block diagram of a label printing system for printing information onto a label of a roll of label stock in accordance with the present invention.

Throughout the drawings, the same reference numerals and characters, unless otherwise stated, are used to denote like features, elements, components, or portions of the illustrated embodiments. Moreover, while the present invention will now be described in detail with reference to the Figures, it is done so in connection with the illustrative embodiments.

DETAILED DESCRIPTION OF THE PREFERRED EMBODIMENTS

Referring to FIGS. 1-6, an exemplary embodiment of the present invention will be described. FIG. 1 illustrates a logical view of a label printing system 10. The label printing system 10 includes a label printer 100 and a computer system 120. The label printer 100 accepts label stock 102 and prints information onto labels of the label stock 102. The label stock 102 includes labels and a stock carrier material. The labels are adhered to the stock carrier material in a manner generally known in the art.

The label printer 100 includes a top of form (hereinafter "TOF") sensor 104, a label size indicator (hereinafter "LSI") sensor 106, a platen 108, a motor 109, a print head 110, an exit point 112, and a processor 116. The processor 116 includes a memory module 118 for storing information, including data that the printer 100 collects. The TOF sensor 104 detects TOF marks 252 (shown in FIG. 2B) and the presence or absence of the label stock 102. The LSI sensor 106 detects LSI marks 254 (shown in FIG. 2B) and the presence or absence of the label stock 102. The motor 109 drives the platen 108, such that the platen 108 turns in a clockwise or counterclockwise direction. Rotation of the platen 108 causes the label stock 102 to advance in a forward direction if the platen 108 rotates in a counter-clockwise or to advance in a reverse direction if the platen 108 rotates in a clockwise direction. The print head 110 prints information onto the labels of the label stock 102. The print head 110 is positioned such that the information is printed at a pinch-point 114 of the platen 108 and the print head 110.

In one embodiment, the memory module 118 includes volatile and nonvolatile memory. In another embodiment, the volatile memory is random access memory. In yet another embodiment, the nonvolatile memory may include flash memory.

The computer system 120 sends print requests to the label printer 100. The label printer 100 sends information to the computer system 120 describing the types of labels contained on the label stock 102, whether or not the label printer 100 is ready to print, and the like. This information allows the computer system 120 to format print requests to the label printer 100.

In one embodiment, the label stock 102 may be contained within a cartridge or case. Use of a cartridge or case containing the label stock 102 allows a user to insert and/or remove labels from the label printer 100 with ease. Once the cartridge or case is inserted into the label printer 100, the label printer 100 begins processing the label stock from the cartridge or case. The label stock 102 is processed through the label printer 100 in substantially the same manner as if the label stock 102 was not contained within the cartridge or case.

Figure 2B:
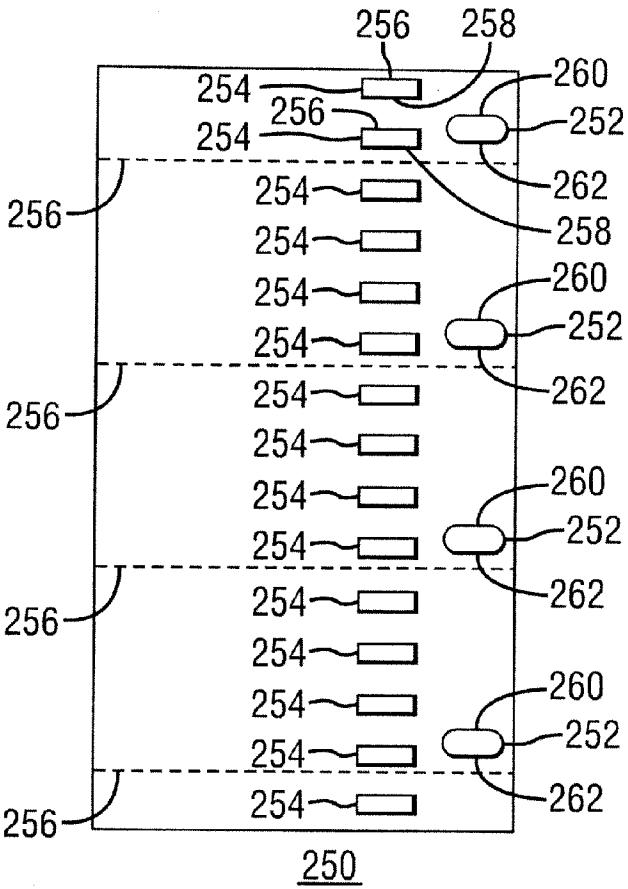
FIGS. 2A and 2B are front and rear views of a roll of label stock in accordance with the present invention.
Figure 2A:
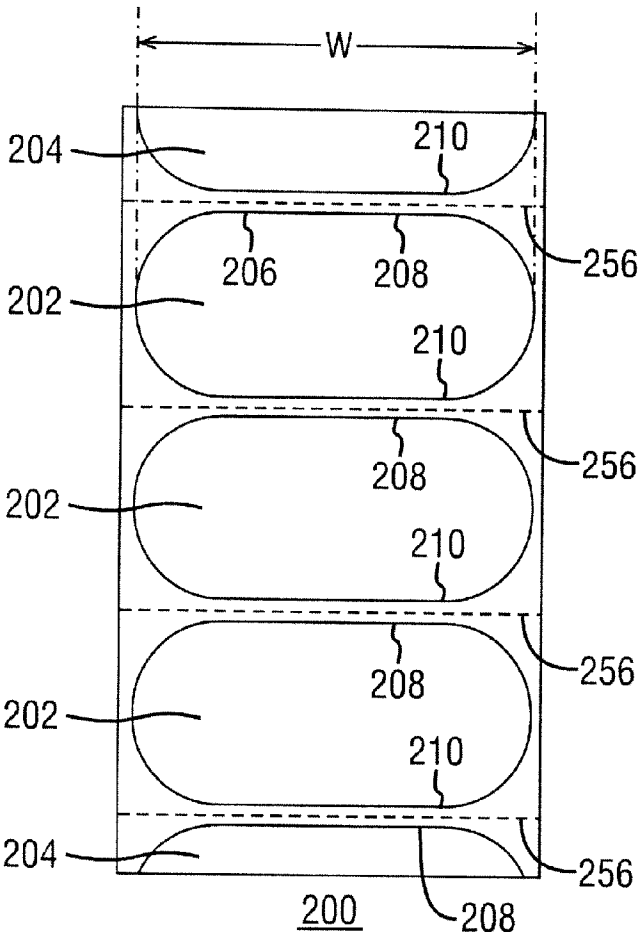

FIG. 2A illustrates a front side 200 or label side of the label stock 102. The front side 200 of the label stock 102 is the side of the label stock 102 where full labels 202 and partial labels 204 are visible. Each of the full labels 202 can be of any width or length. Full labels 202 are labels that have been manufactured to the appropriate width and length specifications. The length of a full label 202 is the distance between a leading edge 208 of the full label 202 to a trailing edge 210 of the full label 202. The width of a full label 202 is the distance across a full label 202 as indicated by W in FIG. 2A. Preferably, each of the full labels 202 have the same width and length. Partial labels 204 are also shown. Partial labels 204 are labels that have not been manufactured to the appropriate width and/or length specifications. During the manufacturing process, partial labels 204 may be unavoidably created at the beginning or end of a roll of label stock. The positional accuracy of the manufacturing equipment is such that the demarcation point between label rolls is random and has no positional relationship to the die cut label on the continuous label carrier. This inaccuracy may cause the first label of a previously unused roll of label stock to begin with a partial label 204. Each of the full labels 202 and each of the partial labels 204 are separated from one another by a boundary 256. The boundary 256 can be a perforation, a line, a series of marks, or the like. The boundary 256 serves as a mechanism for a user to tear the label stock 102 such that one label can be separated from the remainder of the label stock 102.

In one embodiment, the leading edge 208 of a full label 202 and the trailing edge 210 of a full label 202 can be coincident with sequential boundaries 256.

FIG. 2B illustrates a back side 250 or stock carrier side of the label stock 102. The back side 250 of the label stock 102 is the side of the label stock 102 where the labels 202, 204 are not visible. A group of TOF marks 252 and a group of LSI marks 254 are printed on the back side 250 of the label stock 102. The boundaries 256 are also visible on the back side 250 of the label stock 102. The TOF sensor 104 reads the leading edge 260 of the TOF marks 252 and the printer 100 records the position thereof. The printer 100 can position the leading edge 206 of a label 202 in the print cycle initial position by utilizing the TOF marks 252. Positioning the label 202 in the print cycle initial position allows the printer 100 to immediately begin printing the label 202 when a print request arrives.

In one embodiment, the TOF sensor 104 also reads the trailing edge 262 of the TOF marks 252.

The LSI marks 254 are read by the LSI sensor 106 which sensor communicates information to the printer 100. The information received by the printer 100 is recorded and includes positional data about the LSI marks 254. The LSI marks 254 have a leading edge 256 and a trailing edge 258. The leading edge 256 and the trailing edge 258 of the LSI marks 254 can be read by the LSI sensor 106 and recorded by the printer 100. The distance between the leading edge 256 and the trailing edge 258 of the LSI marks 254, i.e. the length of the LSI mark 254, is indicative of the width of the labels of the label stock 102. The mean of the distance between the trailing edge 258 of one LSI mark 254 and the leading edge 256 of the next LSI mark 254, i.e. the mean of the distance between the LSI marks 254, is indicative of the length of the labels 202.

In a preferred embodiment, the labels 260 of the label stock 102 are of varying width. In another preferred embodiment, the labels 260 of the label stock 102 are of varying length. In still another preferred embodiment, each of the TOF marks 252 correspond with a single label. In another preferred embodiment, the TOF mark 252 that corresponds with a particular label is in registration with the particular label. In another preferred embodiment, the TOF mark 252 that corresponds with a particular label is offset from the another particular label. In another preferred embodiment, more than two of the LSI marks 254 correspond with a single label. In still another preferred embodiment, more than two of the LSI marks 254 that correspond with the single label are in registration with the single label. In yet another preferred embodiment, at least one of the more than two of the LSI marks 254 that correspond with a single label are offset from the single label. In a further preferred embodiment, the boundaries 256 are not visible on the back side 250 of the label stock 102.

In a preferred embodiment, the mean of the distance between the trailing edge 258 of an LSI mark 254 and the leading edge 256 of the next LSI mark 254 is proportional to the length of the labels. In another preferred embodiment, the distance between the leading edge 256 and the trailing edge 258 of a particular LSI mark 254 is indicative of the width and length of the labels 202. In a further preferred embodiment, the distance between the leading edge 256 and the trailing edge 258 of a particular LSI mark 254 is indicative of the length of the labels 202.

Figure 3B:
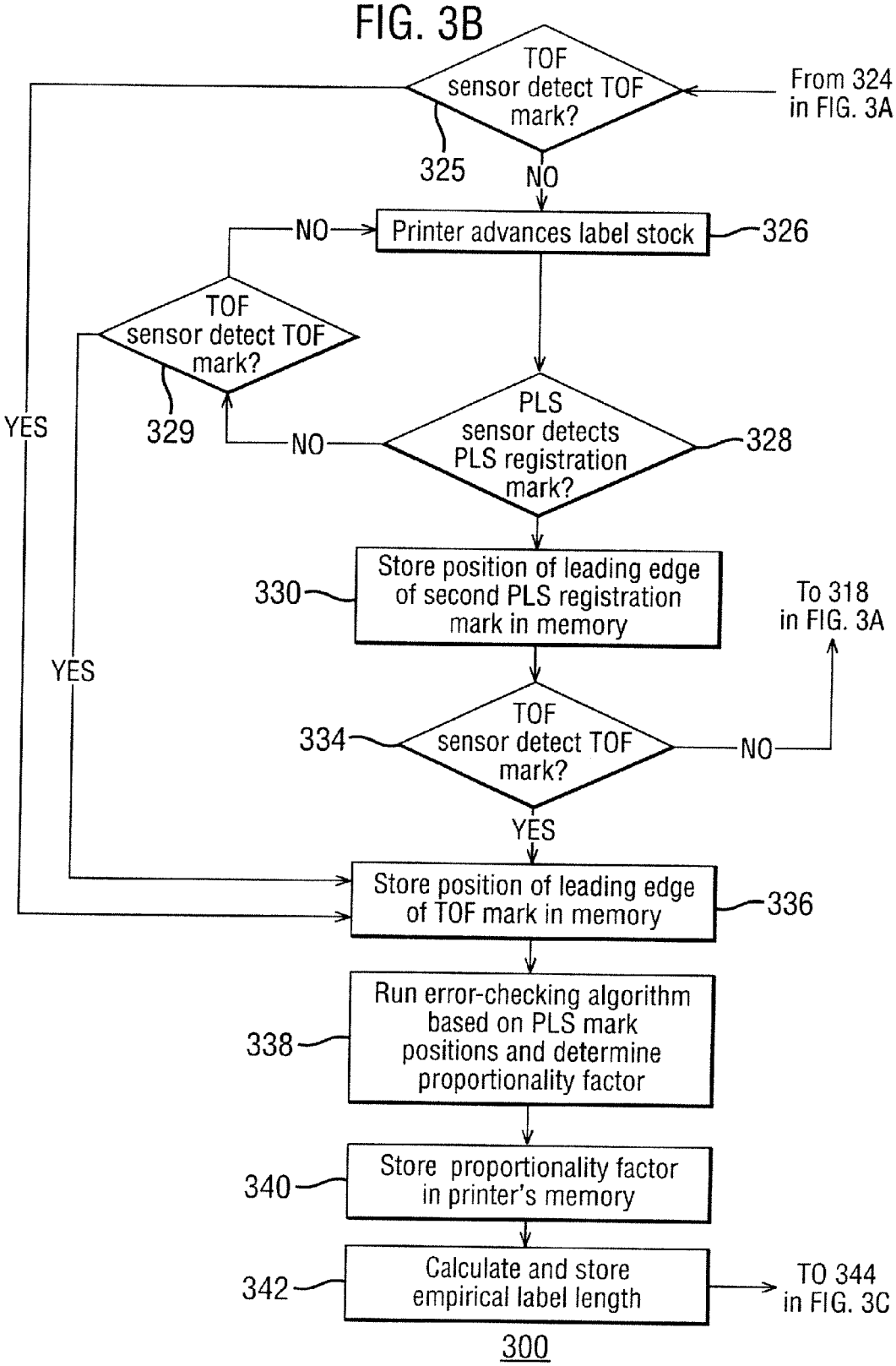
Figure 3C:
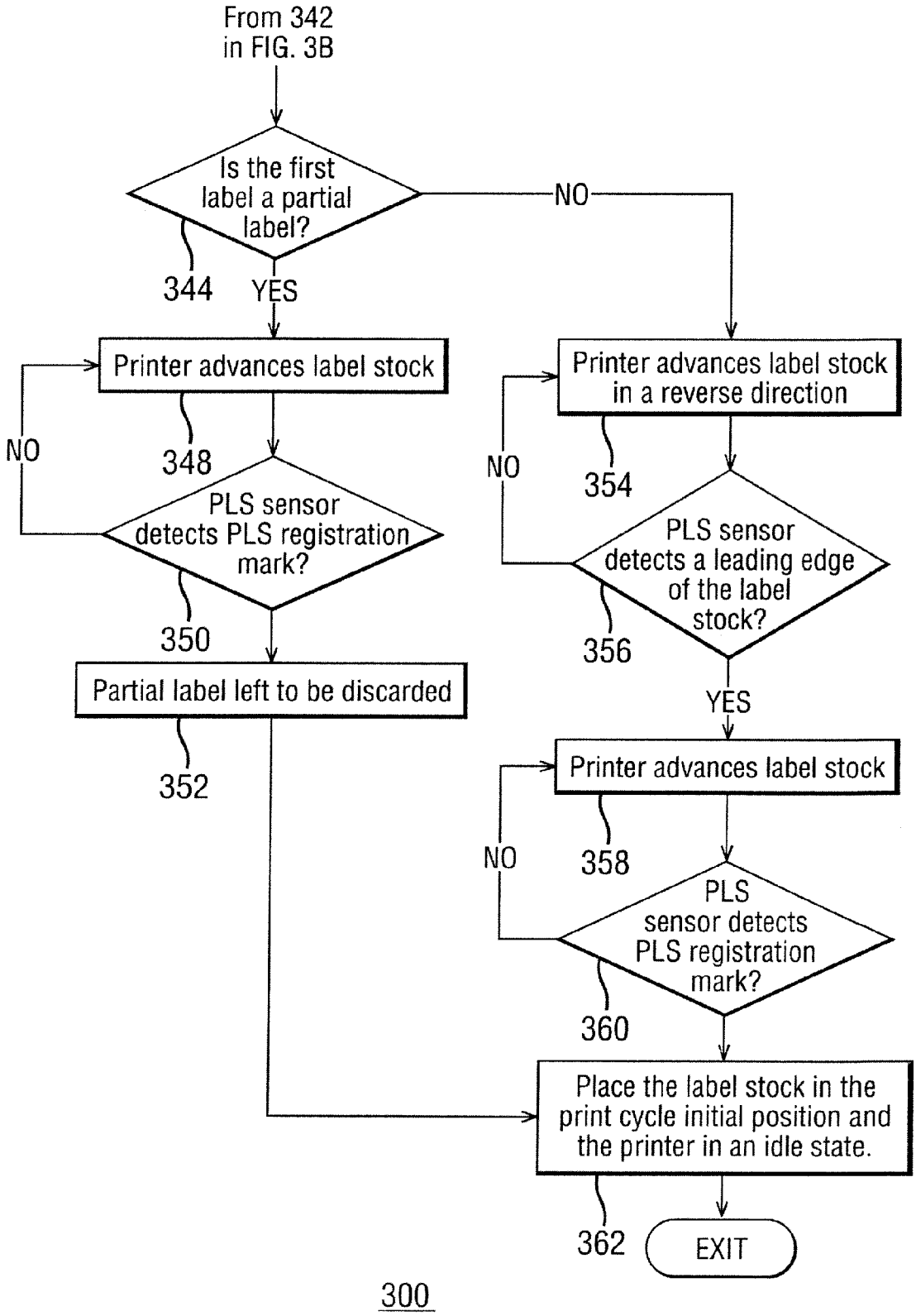

FIGS. 3A-3C illustrate the process 300 for loading a roll of label stock, determining whether the first label of the roll of label stock is a partial label and positioning the roll of label stock 102. The printer 100 begins the process 300 at step 302, shown in FIG. 3A, given one of four conditions: power-up of the printer 100, reset of the printer 100, reload of the label stock 102 into the printer 100, or notification of a need to position a new label of the label stock 102 in the printer 100. At step 302, the processor 116 determines whether the TOF sensor 104 in conjunction with the LSI sensor 106 sense the presence or absence of label stock 102. If the presence of label stock is detected by both the TOF sensor 104 and the LSI sensor 106, it is assumed that the label stock 102 is loaded and staged correctly for a print cycle, the process 300 exits, and the printer 100 places itself in an idle state. Once in the idle state, the printer 100 remains in the idle state until it receives a print job. The position of the label stock 102 is called the print cycle initial position. The print cycle initial position is a position from which the printer 100 does not have to move the label stock 102 in order to begin printing. If the presence of label stock is not detected by either the TOF sensor 104 or the LSI sensor 106, the process 300 advances to step 304.

At step 304, the printer 100 is placed in a load state. While the label printer 100 is in the load state, the label printer 100 is waiting for label stock 102 to be loaded into the printer, such that the TOF sensor 104 detects the presence of label stock 102.

At step 306, the printer 100 determines if the TOF sensor 104 detects the presence of label stock. If the TOF sensor 104 detects the presence of label stock, the printer 100 initiates a load cycle. Otherwise, the process 300 advances to step 304.

At step 308, the load cycle is initiated and the motor 109 drives the platen 108 in a counterclockwise direction, advancing the label stock 102 in a forward direction. Advancing the label stock 102 causes the leading edge of the label stock 102 to be fed into a pinch-point 114 of the platen 108 and print head 110. The LSI sensor 106 informs the printer 100 whether the presence of label stock 102 is sensed at step 310. If the LSI sensor 106 senses the presence of label stock 102, the process 300 advances to step 312. If the presence of label stock 102 is not sensed, the process 300 advances to step 308. Once the LSI sensor 106 senses the presence of label stock 102, the processor 116 records the position in the memory module 118. Recording the position of the leading edge of the label stock 102 allows the printer 100 to calculate how far the leading edge of the label stock 102 is from the print cycle initial position and the TOF sensor 104 once additional information is gathered.

At step 312, the printer 100 causes the motor 109 to drive the platen 108 in a counterclockwise direction, advancing the label stock 102 in a forward direction. The LSI sensor 106 informs the printer 100 whether the leading edge 256 of a LSI registration mark 254 is detected by the LSI sensor 106 at step 314. If the LSI sensor 106 senses the leading edge 256 of a LSI registration mark 254, the process 300 advances to step 316. If, on the other hand, the LSI sensor 106 does not sense the leading edge 256, the process 300 advances to step 312.

At step 316, the processor 116 stores the position of the leading edge 256 of the LSI registration mark 254 in memory module 118. The processor 116 stores the position of the leading edge 256 in relative terms, for example, stepper motor steps, print column increments, and the like, based on the leading edge of the label stock 102.

At step 318, the printer 100 advances the label stock 102 in a forward direction. The LSI sensor 106 informs the processor 116 whether the trailing edge 258 of the LSI registration mark 254 is detected by the LSI sensor 106 at step 320. If the LSI sensor 106 senses the trailing edge 258 of the LSI registration mark 254, the process 300 advances to step 322. If the LSI sensor 106 does not sense the trailing edge 258, the process 300 advances to step 319.

At step 319, the TOF sensor 104 informs the processor 116 whether the TOF mark 252 is detected by the TOF sensor 104.

If the TOF sensor 104 senses the TOF mark 252, the process 300 advances to step 336 (shown in FIG. 3B) to determine certain attributes about the label of the label stock 102. At step 336, the printer 100 stores the position of the TOF mark 252 in memory. If the TOF sensor 104 does not sense the TOF mark 252, the process 300 advances to step 318.

At step 322, the processor 116 stores the position of the trailing edge 258 of the LSI registration mark 254 in the memory module 118. The processor 116 stores the position of the trailing edge 258 in relative terms based on the leading edge of the label stock 102. The processor 116 calculates the length of the LSI registration mark 254 at step 324. The length of the LSI registration mark 254, i.e. the distance between the leading edge 256 and the trailing edge 258 of the LSI registration mark 254 is proportional to the width of the label stock. This value can be sent to a computer system 120 for template and formatting purposes. Once the computer calculates the length of the LSI registration mark 254, the process 300 advances to step 325, shown in FIG. 3B.

At step 325, the TOF sensor 104 informs the processor 116 whether the TOF mark 252 is detected by the TOF sensor 104. If the TOF sensor 104 senses the TOF mark 252, the process 300 advances to step 336 to determine certain attributes about the label of the label stock 102. At step 336, the processor 116 stores the position of the TOF mark 252 in the memory module 118. If the TOF sensor 104 does not sense the TOF mark 252, the process 300 advances to step 326.

At step 326, the printer 100 causes the motor 109 to rotate the platen 108 in a counterclockwise direction, advancing the label stock in a forward direction. The LSI sensor 106 informs the processor 116 whether the leading edge 256 of the LSI registration mark 254 is detected by the LSI sensor 106 at step 328. If the LSI sensor 106 senses the leading edge 256 of the LSI registration mark 254, the process 300 advances to step 330. At step 330, the processor 116 stores the position of the leading edge 256 of the LSI registration mark 254. If, however, the LSI sensor 106 does not sense the leading edge 256, the process 300 advances to step 329 to determine if the TOF sensor 104 senses the TOF mark 252.

At step 329, the TOF sensor 104 informs the processor 116 whether the TOF mark 252 is detected by the TOF sensor 104. If the TOF sensor 104 senses the TOF mark 252, the process 300 advances to step 336 to determine certain attributes about the label of the label stock 102. At step 336, the processor 116 stores the position of the TOF mark 252 in the memory module 118. If the TOF sensor 104 does not sense the TOF mark 252, the process 300 advances to step 326.

At step 334, the TOF sensor 104 informs the processor 116 whether the TOF mark 252 is detected by the TOF sensor 104. If the TOF sensor 104 senses the TOF mark 252, the process 300 advances to step 336 to determine certain attributes about the label of the label stock 102. At step 336, the processor 116 stores the position of the leading edge of the TOF mark 252 in the memory module 118. If the TOF sensor 104 does not sense the TOF mark 252, the process 300 advances to step 318 to determine if the LSI sensor 106 senses the trailing edge 258 of the LSI registration mark 254.

The distance between the LSI registration marks 254, i.e. the distance between the trailing edge 258 of the LSI registration mark 254 sensed at step 320 and the leading edge 256 of the LSI registration mark 254 sensed at step 328, and the length of successive LSI registration marks 254 are calculated based on the information stored in the memory module 118 by the processor 116. The successive distances between the LSI registration marks 254 are run through an error-checking algorithm to test for and remove extraneous data. The mean of the successive distances is proportional to the length of the labels, i.e. distance between successive TOF marks 252, and is returned to the computer system 120 for template and formatting purposes. The processor 116 calculates and stores the derived label length in the memory module 118 at step 340. The derived label length is calculated by multiplying the value of the mean of the successive distances and a proportionality factor. The proportionality factor is stored in the memory module 118 of the printer 100.

The processor 116 calculates and stores the empirical label length at step 342. The empirical label length is calculated by determining the distance the label stock has traveled from the point the leading edge of the label stock was detected by the LSI sensor 106 at step 310 to the point that the first TOF mark 252 is detected and adding that distance to the known fixed distance between the LSI sensor 106 and the TOF sensor 104. The fixed distance between the LSI sensor 106 and the TOF sensor 104 is stored in the memory module 118. Once the empirical label length is calculated, it is stored in the memory module 118 of the printer 100.

At this point, the label stock has not advanced in a forward direction to the point that an entire label has progressed beyond the pinch-point 114. Because the derived and empirical label length values are determined in less than one label length, the trailing edge of the first die cut label does not pass past the pinch-point 114, thereby diminishing the chances of a label printer 100 malfunction.

At step 344, the processor 116 determines if the first label of the label stock 102 is a partial label. The processor 116 compares the derived label length value to the empirical label length value to determine, within a reasonable probability, whether the first label of the label stock 102 is a full or partial label. If the first label of the label stock 102 is a partial label, the process 300 advances to step 348. Otherwise, the process 300 advances to step 354.

At step 348, the processor 116 causes the motor 109 to rotate the platen 108 in a counterclockwise direction, advancing the label stock in a forward direction. The LSI sensor 106 informs the processor 116 whether the leading edge 256 of the LSI registration mark 254 is detected by the LSI sensor 106 at step 350. If the LSI sensor 106 senses the leading edge 256 of the LSI registration mark 254, the process 300 advances to step 352. The printer 100 stops advancing the label stock 102 at step 352 and the label stock 102 is left protruding from the printer label exit point 112 allowing for the removal of the partial label. If, however, the LSI sensor 106 does not sense the leading edge 256 of the LSI registration mark 254, the process 300 advances to step 348.

At step 354, the motor 109 drives the platen 108 in a clockwise direction, advancing the label stock 102 in a reverse direction. The LSI sensor 106 informs the processor 116 whether the presence of label stock 102 is sensed at step 356. If the LSI sensor 106 senses the absence of label stock 102, i.e. the leading edge of the label stock 102, the process 300 advances to step 358. Otherwise, the process 300 advances to step 354.

At step 358, the printer 100 causes the motor 109 to drive the platen 108 in a counterclockwise direction, advancing the label stock 102 in a forward direction. The LSI sensor 106 informs the printer 100 whether the leading edge 256 of a LSI registration mark 254 is detected by the LSI sensor 106 at step 360. If the LSI sensor 106 senses the leading edge 256 of a LSI registration mark 254, the process 300 advances to step 362. If, on the other hand, the LSI sensor 106 does not sense the leading edge 256, the process 300 advances to step 358.

At step 362 the printer 100 positions the label stock in the print cycle initial position and places itself in an idle state. Based upon the known positional information of the LSI registration mark 254 and the known length and width of the label, the printer 100 positions the label of the label stock in the print cycle initial position. Once the label stock is positioned accurately, the printer places itself in the idle state. The printer 100 waits in the idle state for an initiation of a print cycle.

Figure 4:
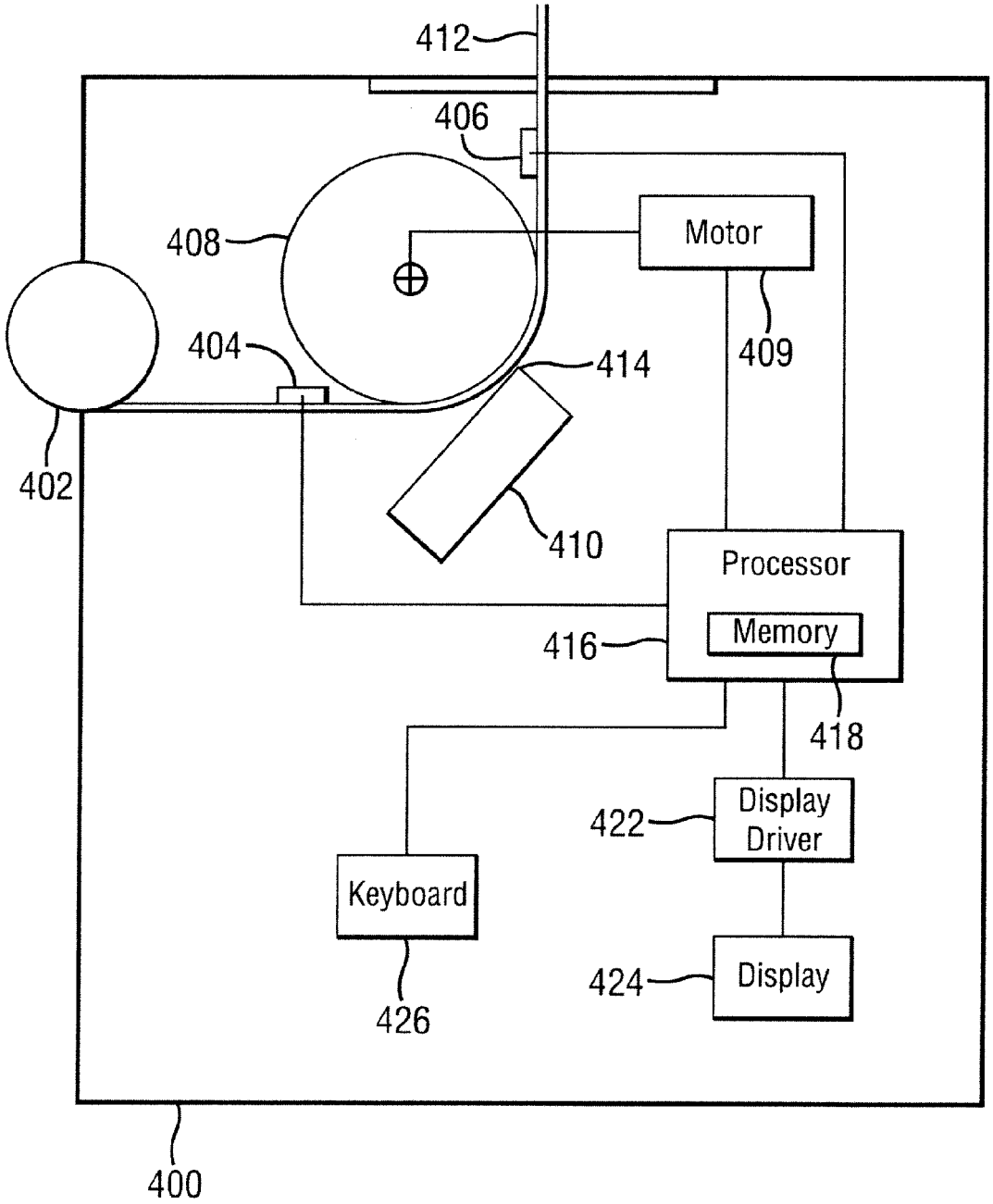
FIG. 4 is a block diagram of a label printing apparatus for printing information onto a label of a roll of label stock in accordance with the present invention.

Referring to FIG. 4, an alternative embodiment of the present invention will be described. FIG. 4 illustrates a schematic view of a label printer 400. The label printer 400 differs from the label printing system 10 shown in FIG. 1 in that the label printer 400 does not need to be connected to a computer system 120 in order to print labels. Like elements of the label printer 400 and the label printing system 10 are given like reference numerals. The label printer 400 accepts label stock 402 and prints information onto labels of the label stock 402. The label stock 402 includes labels and a stock carrier material. The labels are adhered to the stock carrier material in a manner generally known in the art.

The label printer 400 includes a top of form (hereinafter "TOF") sensor 404, a label size indicator (hereinafter "LSI") sensor 406, a platen 408, a motor 409, a print head 410, an exit point 412, and a processor 416. The processor 416 includes a memory module 418 for storing information, including data that the label printer 400 collects. The TOF sensor 404 detects TOF marks 252 (shown in FIG. 2B) and the presence or absence of the label stock 402. The LSI sensor 406 detects LSI marks 254 (shown in FIG. 2B) and the presence or absence of the label stock 402. The motor 409 drives the platen 408, such that the platen 408 turns in a clockwise or counterclockwise direction. Rotation of the platen 408 causes the label stock 402 to advance in a forward direction if the platen 408 rotates in a counter-clockwise or to advance in a reverse direction if the platen 408 rotates in a clockwise direction. The print head 410 prints information onto the labels of the label stock 402. The print head 410 is positioned such that the information is printed at a pinch-point 414 of the platen 408 and the print head 410.

In one embodiment, the memory module 418 includes volatile and/or nonvolatile memory. In another embodiment, the volatile memory is random access memory. In yet another embodiment, the nonvolatile memory may include flash memory.

The label printer 400 further comprises a display driver 422, a display 424 and a keyboard or similar user interface 426. The display 424 is connected to display driver 422, which in turn is connected to the processor 416. The keyboard 426 is also connected to processor 416.

The processor 416 processes information describing the types of labels contained on the label stock 402, whether or not the label printer 400 is ready to print, and the like. The processor 416 further comprises a graphical user interface, which is displayed on display 424, and which allows a user to interact with via keyboard 426. For example, the user may thus input to the label printer 400 text and formatting information so as to generate a particular label. The particular label may then be printed and output by said label printer 400.

Figure 5:
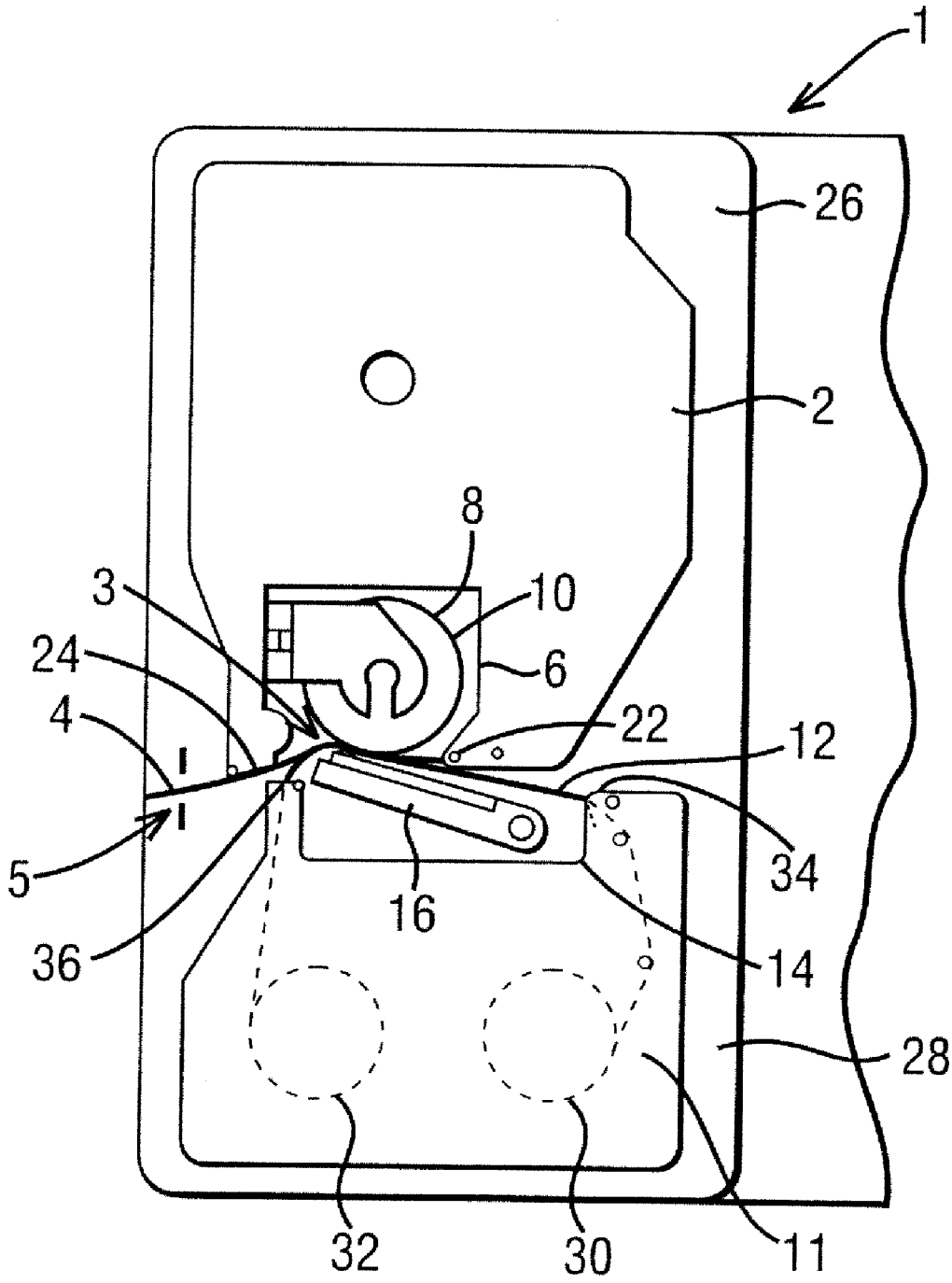
FIG. 5 is a plan view of a tape printing device embodying the present invention using a two cassette system.
Figure 6:
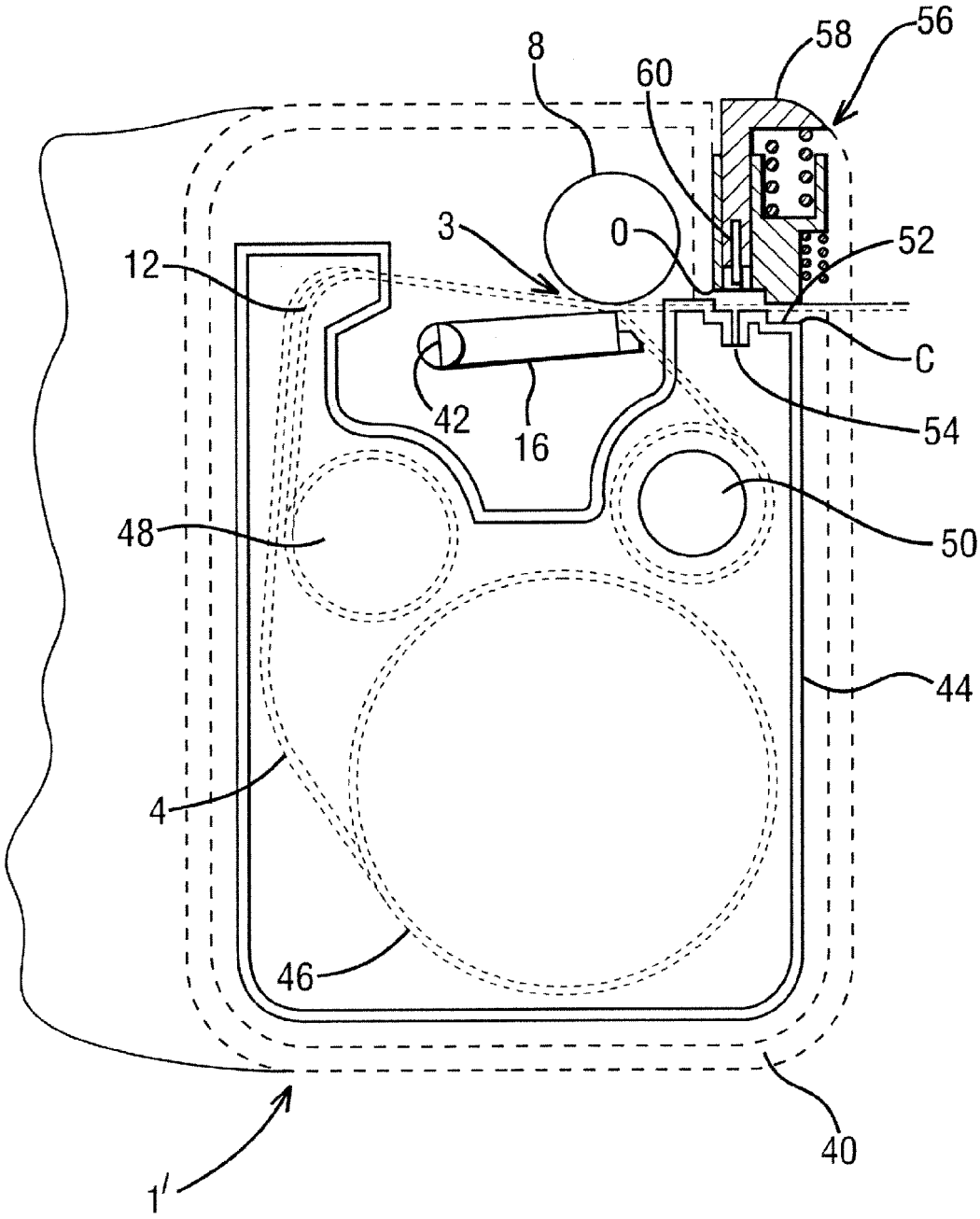
FIG. 6 is a plan view of an alternative tape printing device embodying the present invention, using a one cassette system.

As described in relation to FIGS. 5 and 6, the label stock 402 may be contained within a cartridge or case. Use of a cartridge or case containing the label stock 402 allows a user to insert and/or remove labels from the label printer 400 with ease. Once the cartridge or case is inserted into the label printer 400, the label printer 400 begins processing the label stock from the cartridge or case. The label stock 402 is processed through the label printer 400 in substantially the same manner as if the label stock 104 was not contained within the cartridge or case.

FIG. 5 shows in plan view, a tape printing device 1 embodying the present invention which has two cassettes arranged therein. Such a cassette system may be known as a D2 system. An upper cassette 2 is located in a first cassette receiving portion 26 and contains a supply 4 of die cut labels on a backing which passes through a print zone 3 of the tape printing device 1 to an outlet 5 of the tape printing device 1. The supply tape 4 comprises an upper layer for receiving a printed image on one of its surfaces and has its other surface coated with an adhesive layer to which is secured a releasable backing layer. The upper cassette 2 has a recess for accommodating a platen 8 of the tape printing device 1, and guide portions 22 and 24 for guiding the tape through the print zone 3. The platen 8 is mounted for rotation within a cage moulding 10. Alternatively, the platen could be mounted for rotation on a pin.

A lower cassette 11 is located in a second cassette receiving portion 28 and contains a thermal transfer ribbon 12 which extends from a supply spool 30 to a take up spool 32 within the cassette 11. The thermal transfer ribbon 12 extends through the print zone 3 in overlap with the supply tape 4. The cassette 11 has a recess 14 for receiving a print head 16 of the tape printing device 1 and guide portions 34 and 36 for guiding the thermal transfer ribbon 12 through the print zone 3. The print head 16 is movable between an operative position shown in FIG. 1, in which it is in contact with the platen 8 and holds the thermal transfer ribbon 12 and the supply tape 4 in overlap between the print head 16 and the platen 8 and in an inoperative position in which it is moved away from the platen 8 to release the thermal transfer ribbon 12 and supply tape 4. In the operative position, the platen 8 is rotated to cause the image receiving tape 12 to be driven past the print head 16 and the print head 16 is controlled to print an image on the supply tape 4 by thermal transfer of ink from the ribbon 12.

The tape printing device 1 has a lid (which is not shown) but which is hinged along the rear of the cassette receiving portions 26 and 28 and which covers both cassettes when in place. The lid may of course be hinged to the tape printing device in any other suitable way. In alternative embodiments of the invention, the lid may not be hinged but may be attached to the tape printer; when required, in any other suitable way.

A dc motor continuously drives the platen 8. The platen is arranged to drive the supply tape 4 through the print zone 3 by the actuation of its own rotation.

The image is printed by the print head 16 on the image receiving tape on a column by column basis with the columns being adjacent one another in the direction of movement of the tape 4.

The tape printing device 1 may be a label printer (e.g. label printer 100) that must be connected to a PC in order to print labels as depicted in FIG. 1; or alternatively, the printing device 1 may be a stand-alone printer such as label printer 400, which does not need to be connected to a computer system in order to print labels, as depicted in FIG. 4.

FIG. 6 illustrates in plan view a cassette bay of an alternative printing device 1' embodying the present invention which uses a one cassette system. Such a cassette system may be known as a D1 system. Like reference numerals are used for those parts which are also shown in FIG. 5. The cassette bay is shown by the dotted line 40. The cassette bay 40 includes a thermal print head 16 and a platen 8 which cooperate to define a print zone 3. The thermal print head 16 is the same as that discussed in relation to FIG. 2.

The print head 16 is pivotable about a pivot point so that it can be brought into contact with the platen 8 for printing and moved away from the platen 8 to enable the cassette to be removed and replaced as in the first embodiment. A cassette inserted into the cassette bay 40 is denoted generally by reference numeral 44. The cassette 44 holds a supply spool 46 of supply tape 4. The supply tape 4 is guided by a guide mechanism (which is not shown) through the cassette 44, out of the cassette 44 through an outlet O past the print zone 3 to a cutting location C. The same cassette 44 also has an ink ribbon supply spool 48 and an ink ribbon take up spool 50. The ink ribbon 12 is guided from the ink ribbon supply spool 48 through the print zone 3 and taken up on the ink ribbon take up spool 50. As with the printing device 1, the supply tape 4 passes in overlap with the ink ribbon 12 through the print zone 3 with its image receiving layer in contact with the ink ribbon 12. The platen of the printing device 1' is also driven by a motor 7. The motor rotates to drive the image receiving tape through the print zone 3 continuously during printing. In either of the printing devices 1 or 1', it is possible that the tape be driven in a step wise manner by a stepper motor. In other embodiments, a different type of motor may be used.

An image is printed on the tape fed out from the print zone to the optional cutting location C which is provided at a location in a portion of the wall of the cassette 44 which is close to the print zone 3. The portion of the wall on the cassette 44 where the cutting location C is defined is denoted by reference 52. A slot 54 is defined in the wall portion 52 and the supply tape 4 is fed past the print zone 3 to the cutting location C where it is supported by facing wall portions on either side of the slot 54. The cutter is optional and may be arranged to cut through the backing layer.

The alternative tape printing device 1' is shown in FIG. 6 as including a cutting mechanism 56 including a cutter support member 58 which carries a blade 60. The blade 60 cuts the supply tape 4 and then enters the slot 54. Tape printing device 1 may optionally include a cutting mechanism.

The ink ribbon can be omitted in certain embodiments where the image receiving tape is of a thermally sensitive material. In this case, the image is printed by the thermal print head directly onto the thermally sensitive image receiving tape.

The alternative printing device 1' may be a label printer (e.g. label printer 100) that must be connected to a PC in order to print labels as depicted in FIG. 1; or alternatively, the alternative printing device 1' may be a stand-alone printer such as label printer 400, which does not need to be connected to a computer system in order to print labels, as depicted in FIG. 4.

Accordingly, the present invention may be embodied in any one of the following apparatus:

a standalone label printer as in label printer 400 comprising a D1 type cassette system as described above in relation to FIG. 6;

a standalone label printer as in label printer 400 comprising a D2 type cassette system as described above in relation to FIG. 5;

a PC label printer as in label printer 100 comprising a D1 type cassette system as described above in relation to FIG. 6;

a PC label printer as in label printer 100 comprising a D2 type cassette system as described above in relation to FIG. 5;

The foregoing merely illustrates the principles of the invention. Various modifications and alterations to the described embodiments will be apparent to those skilled in the art in view of the teachings herein. For example, the labels may be of varying dimensions throughout the label stock. It will thus be appreciated that those skilled in the art will be able to devise numerous techniques which, although not explicitly described herein, embody the principles of the invention and are thus within the spirit and scope of the invention.

The invention claimed is:

1. A label printer in combination with a roll of labels;

the roll of labels comprising a substrate having a front side and a back side, and at least one indicator mark on the back side of the substrate, wherein one of said at least one indicator mark has a particular length; and a plurality of labels, wherein said plurality of labels is adhered to said front side of said substrate, wherein one of said plurality of labels has a particular dimension, wherein said label printer is configured to calculate said particular length of said one of said at least one indicator mark so as to determine said particular dimension of said one of said plurality of labels, and wherein said particular dimension is one of a length of said one of said plurality of labels and a width of said one of said plurality of labels.

2. The combination of claim 1, wherein each of said plurality of labels has a particular width.

3. The combination of claim 1 wherein each of said plurality of labels has a particular length.

4. The combination of claim 1 wherein said particular length of said one of said at least one indicator mark is indicative of the length and width of said one of said plurality of labels.

5. The combination of claim 1, wherein said one of said at least one indicator mark is associated with one of said plurality of labels.

6. The combination of claim 1, wherein said one of said at least one indicator mark is associated with one of said plurality of labels based on position.

7. The combination of claim 6, wherein said one of said at least one indicator mark is printed on said back side of said substrate and said one of said at least one label is adhered to said front side of said substrate at an adjacent location.

8. The combination of claim 7, wherein the roll of labels is housed in a cassette.

9. The combination of claim 6, wherein said one of said at least one indicator mark is printed on said back side of said substrate and said one of said at least one label is adhered to said front side of said substrate at an offset location.

10. The combination of claim 9, wherein the roll of labels is housed in a cassette.

11. The combination of claim 1, wherein the label printer is configured to calculate said particular length of said one of said at least one indicator mark by calculating a distance between a leading edge of said at least one indicator mark and a trailing edge of said at least one indicator mark.

12. The combination of claim 1, wherein the label printer is configured to store a calculated length of said at least one indicator mark in a memory module of the label printer.

13. The combination of claim 1, wherein the label printer is configured to send a calculated length of said at least one indicator mark to a computer system for template and formatting purposes.

14. The combination of claim 1, wherein the label printer is configured to be set into a print cycle initial position based upon a calculation of said particular length of said one of said at least one indicator mark.

15. The combination of claim 1, wherein said label printer is a standalone printer.

16. The combination of claim 1, wherein said label printer is arranged to be connected to a personal computer.

17. The combination of claim 1 wherein said at least one indicator mark is printed on the back side of the substrate.

18. A method for a label printer to determine a particular dimension of one of a plurality of labels adhered to a front side of a roll of label stock, the method comprising:

calculating a particular length of at least one indicator mark on a back side of said roll of labels; and determining said particular dimension of said one of a plurality of labels based on said particular length of said at least one indicator mark, wherein said particular dimension is one of a length of said one of a plurality of labels and a width of said one of a plurality of labels.

19. The method of claim 18, wherein said calculating a particular length of said at least one indicator mark comprises:

(a) sensing a leading edge of said at least one indicator mark;

(b) sensing a trailing edge of said at least one indicator mark;

(c) calculating said length of said at least one indicator mark based on a distance between said leading edge and said trailing edge of said indicator mark.

20. The method of claim 18, comprising sending a calculated length of said at least one indicator mark to a computer system for template and formatting purposes.

21. The method of claim 18, comprising setting the label printer into a print cycle initial position based upon a calculation of said particular length of said one of said at least one indicator mark.

22. The method of claim 18, wherein said at least one indicator mark is printed on the back side of the substrate.

* * * * *